United States Patent [19]

Hanson

[11] Patent Number: 4,932,084

[45] Date of Patent: Jun. 12, 1990

[54] TOILET TANK COVER

[76] Inventor: Marybeth Hanson, 12 Old Forge Crossing, Devon, Pa. 19333

[21] Appl. No.: 343,994

[22] Filed: Apr. 26, 1989

[51] Int. Cl.[5] ..... E03D 1/00

[52] U.S. Cl. ..... 4/353; 4/661

[58] Field of Search ..... 4/353, 661; 150/150, 150/165

[56] References Cited

U.S. PATENT DOCUMENTS 2,099,932 11/1937 Isaacson ..... 4/353
3,170,168 2/1965 Cicatello ..... 4/353
4,174,589 11/1979 Daharsh ..... 4/353
4,307,923 12/1981 Raz ..... 4/353

*Primary Examiner*—Henry J. Recla
*Assistant Examiner*—Glenn T. Barrett
*Attorney, Agent, or Firm*—John Lezdey

[57] ABSTRACT

A decorative toilet tank cover includes a multiplicity of containment areas, at least one of which includes apertures on the bottom for drainage. A lid to cover at least one of the containment areas is provided with a slit for dispensing facial tissues. At least one side includes an integral decorative facade.

4 Claims, 1 Drawing Sheet

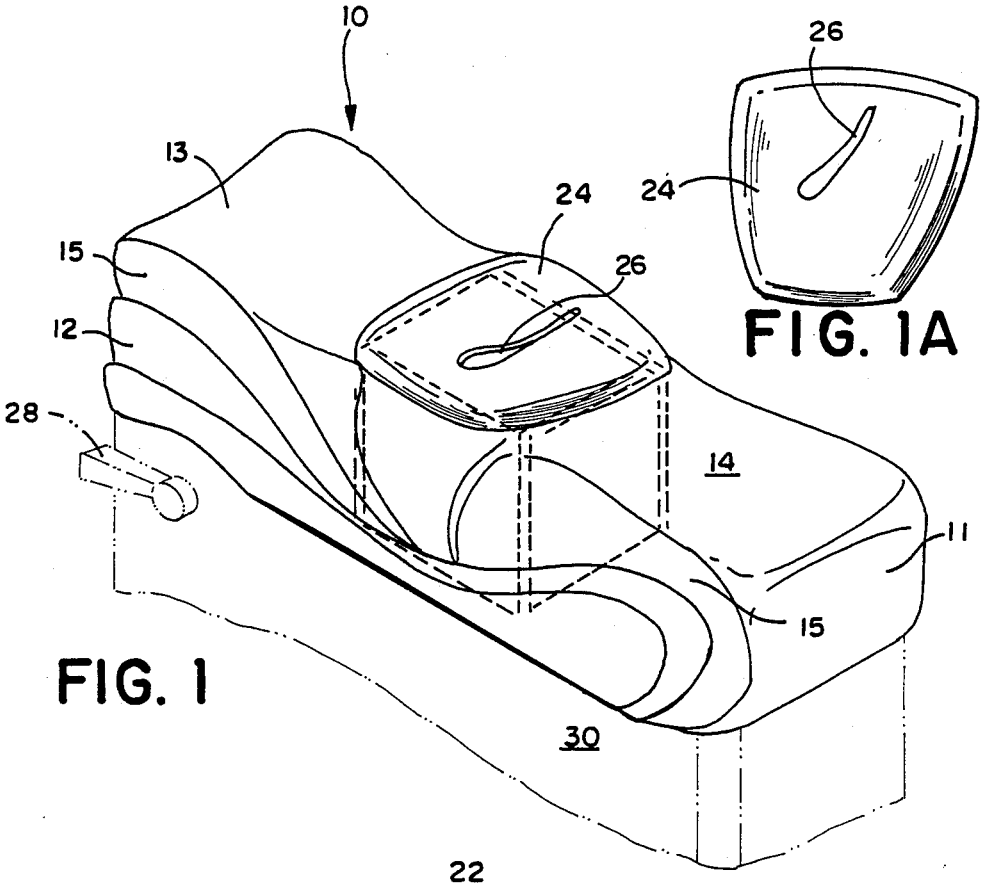
FIG. 1
FIG. 1A
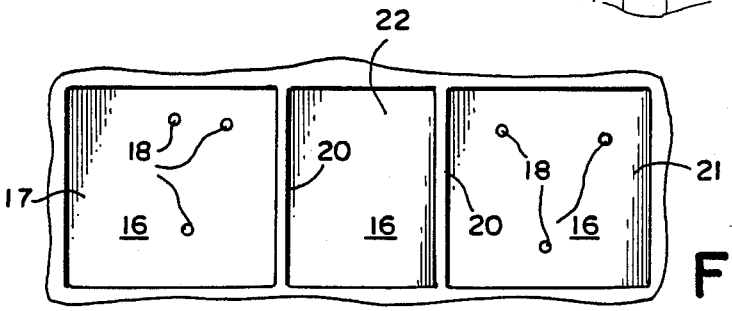
FIG. 2
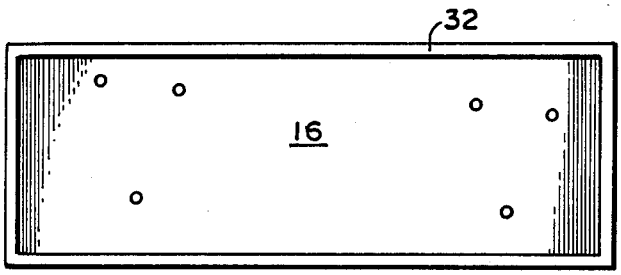
FIG. 3
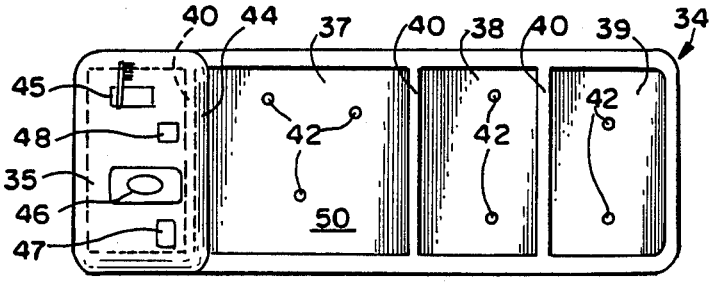
FIG. 4

TOILET TANK COVER

BACKGROUND OF THE INVENTION

1. Field of the Invention

This invention relates to a toilet tank cover, and in particular to a toilet tank cover with a compartmentalized containment area.

2. Description of the Prior Art

There are many toilet tank designs available to suit the functional need or the ornamental design choice of the homeowner. With increased emphasis on home decorating extending beyond the living rooms and into the kitchens and baths, there is increased need for a choice in even the conventional fixtures, such as the toilet tank. Unlike older homes with only small windows in the bathrooms, many new homes have skylights providing sunlight to the bathrooms, allowing the homeowner to keep live plants in the bathroom. Many homeowners like to place decorative items and/or live plants in their bathroom but do not have the room to place plant stands or the like in a small bathroom. There is, therefore, a need for a receptacle for decorative items and live plants which will not require the addition of any furniture or shelving to the bathroom, and which can utilize drainage holes advantageously. Presently, toilet tank covers add no aesthetic appeal to a bathroom and there is a need for a toilet tank cover which will be functional and still improve the appearance of the bathroom.

SUMMARY OF THE DISCLOSURE

The aforementioned need is obviated by the decorative toilet tank cover of this invention which provides a compartmentalized containment area, of which one or more compartments may act as a receptacle for a planter or other similar container and one area includes means for dispensing facial tissues. The tank cover also includes extensions and/or decorative elements which screen the bottom of the tank cover. The tissue dispensing area and/or other containment compartments may also include a removable lid. The underside of the tank cover includes a circumferential lip to prevent movement.

Preferably, the tank cover is provided with a decorative facade on at least one of its sides. Advantageously, the facade is made integral with the side.

The compartments in the tank cover may be the same or of different size or shape depending upon their ultimate utility. Included in the items which may be stored in the compartments are plants, fragrance producing articles, toiletries, etc.

It is, therefore, an object of this invention to provide a toilet tank cover which includes a multiplicity of compartments in a containment area.

It is a further object of this invention to provide a toilet tank cover which receives and retains a facial tissue box.

It is a further object of this invention to provide a toilet tank cover which includes a cover for a facial tissue box compartment.

It is yet another object of this invention to provide a toilet tank cover which includes a circumferential lip on its underside to prevent slippage.

It is still another object of this invention to provide a toilet tank cover which includes aperture means for drainage.

It is still a further object of this invention to provide a toilet tank cover which has decorative elements on its sides and/or top.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWING(S)

FIG. 1 is a perspective view of the toilet tank cover with a partial view of the tank in phantom. FIG. 1A is a top view of the lid to the facial tissue compartment.

FIG. 2 is a top view of the inside of the cover of FIG. 1, showing three compartments.

FIG. 3 is a view of the underside of the tank cover.

FIG. 4 is a view of the inside of an alternative tank cover with an alternative arrangement of the interior walls.

DETAILED DESCRIPTION OF THE PREFERRED EMBODIMENT(S)

Referring now to the drawings, and more particularly to FIGS. 1, 1A and 2, the preferred embodiment, toilet tank cover 10, is seen in position on tank 30 (shown in partial view in phantom). Tank cover 10 has sides 11, 12, 13 and 14, all of which extend upward from the bottom 16 of cover 10 to provide a containment area in said cover. Side 12 includes integral decorative elements 15 which extend upward beyond the edges of side 12 and screen bottom 16 from view. In the embodiment illustrated in FIGS. 1, 1A and 2, there are two interior walls 20 forming three containment areas 17, 21, and 22. Containment areas 17 and 21 include apertures 18 in bottom 16. Apertures 18 provide drainage when plants placed in areas 17 and 21 are watered and also serve as means for moisture from the water in the toilet tank reservoir to reach the plants.

Containment area 22 is sized to retain a facial tissue box and is fitted with removable lid 24 which includes tissue dispensing slit 26. Although lid 24 is seen to cover only containment area 16, lid 24 may be sized to cover more than one containment area. It is preferred that cover 10 be porcelain or ceramic, but lid 24 may be plastic as well.

FIG. 3 shows the underside of bottom 16 which includes apertures 18 and circumferential lip 32. The distance between the interior edges of lip 32 is proximate the distance between the exterior edges of the toilet tank 30 so that cover 10 overfits tank 30 closely without shifting.

Now referring to FIG. 4, an alternative embodiment of the toilet tank cover of this invention is shown having bottom 50 with drainage apertures 42 and three interior walls 40. Walls 40 are not spaced equidistant in cover 34 and form dissimilar containment areas 35, 37, 38 and 39. An alternative lid 44 is placed over containment area 35. Lid 44 includes a plurality of apertures sized to receive articles. For example, aperture 45 holds a toothbrush; aperture 46 holds a soap dish; apertures 48 and 47 may hold other items, such as a fragrance dispensing element.

A decorative toilet tank cover 10 for covering a toilet tank reservoir is an open box having an open top, a closed bottom 16, and four sides 11, 12, 13 and 14, side 12 including a decorative integral facade. Cover 10 includes interior walls 20 which form a multiplicity of containment areas 17, 21 and 22. The underside of cover 10 includes a circumferential lip 32. A removable lid 24 is provided to cover at least one of the containment areas and may include a tissue dispensing slit 24 or apertures 45, 46, 47 and 48 sized to receive different articles. Bottom 16 in containment areas 21 and 17 includes apertures for drainage. Walls 20 are of similar height or dissimilar height. Lip 32 is sized to provide a close overfit to tank 30. Containment area 22 is sized to receive a tissue box and other containment areas may be sized to retain other elements, fragrance dispensing elements, for example. Advantageously, the containment areas 17 and 21 are sized to receive pots or containers of plants, live or artificial.

There are several variations which can be practiced in the scope of this invention. The interior walls may vary in number and in height. The lid, with or without slits or apertures, may cover the entire cover or only a portion thereof. The containment areas include apertures or have solid bottoms. Although it is preferred that the toilet tank cover be porcelain or ceramic, metallic or plastic covers are within the scope of this invention.

Having now illustrated and described my invention, it is not intended that such description limit this invention, but rather that this invention be limited only by reasonable interpretation of the appended claims.

What is claimed is:

1. A decorative toilet tank cover for covering the top of a toilet tank reservoir comprising:

an elongated open box having an open top, a closed bottom, four sides and at least two interior walls forming at least three containment areas, one of said containment areas being sized to receive a facial tissue box and at least one of said containment areas being adapted for receiving a plant and having drain holes, the bottom of said box including a circumferential lip being adapted to be mounted on the top of the toilet tank reservoir, at least one of the sides of said box having a decorative integral facade, and a removable cover for covering said containment area receiving a facial tissue box, said removable cover having a slit adapted for dispensing tissues from said containment area receiving a tissue box.

2. The toilet tank cover according to claim 1 wherein said lip is sized to closely overfit the top of a toilet tank.

3. The toilet tank cover according to claim 1 further including a second removable cover covering one of said containment areas, said second removable cover having a plurality of apertures for receiving articles therein.

4. The toilet tank cover of claim 1 comprising one containment area for receiving a tissue box and two containment areas having drainage holes and adapted for receiving plants.

* * * * *